US011034035B2

(12) United States Patent
Chen

(10) Patent No.: US 11,034,035 B2
(45) Date of Patent: Jun. 15, 2021

(54) UTILITY KNIFE

(71) Applicant: MING SHIN TOOLS CO., LTD., Taichung (TW)

(72) Inventor: Yung-Shun Chen, Taichung (TW)

(73) Assignee: Ming Shin Tools Co., Ltd., Taichung (TW)

( * ) Notice: Subject to any disclaimer, the term of this patent is extended or adjusted under 35 U.S.C. 154(b) by 115 days.

(21) Appl. No.: 16/537,161

(22) Filed: Aug. 9, 2019

(65) Prior Publication Data

US 2021/0039270 A1 Feb. 11, 2021

(51) Int. Cl.
*B26B 5/00* (2006.01)
*B26B 1/08* (2006.01)

(52) U.S. Cl.
CPC ..... *B26B 5/003* (2013.01); *B26B 1/08* (2013.01)

(58) Field of Classification Search
CPC ..... B26B 5/003; B26B 1/08
USPC ..... 30/162
See application file for complete search history.

(56) References Cited

U.S. PATENT DOCUMENTS 4,939,839 A * 7/1990 Gorst ..... B26B 5/001 30/125
5,022,156 A * 6/1991 Kallens ..... B26B 5/00 30/125
5,301,428 A * 4/1994 Wilcox ..... B26B 5/001 30/125
6,026,575 A * 2/2000 Wonderley ..... B26B 5/00 30/125
6,249,975 B1 * 6/2001 Lin ..... B26B 5/001 30/162
6,574,872 B2 * 6/2003 Roberts ..... B26B 5/00 30/124
6,802,126 B2 * 10/2004 Huang ..... B26B 5/001 30/162
6,865,816 B1 * 3/2005 Zajdel ..... B26B 5/00 30/162
6,971,178 B2 * 12/2005 Rowlay ..... B26B 5/001 30/125
7,107,688 B1 * 9/2006 Critelli ..... B26B 5/001 30/125

(Continued)

FOREIGN PATENT DOCUMENTS

TW I309197 B 5/2009

*Primary Examiner* — Hwei-Siu C Payer
(74) *Attorney, Agent, or Firm* — Muncy, Geissler, Olds & Lowe, P.C.

(57) ABSTRACT

A utility knife is provided, including: a first housing, a second housing, a blade carrier and a locking mechanism. The first housing includes a shaft disposed thereon and having an axis. The second housing is rotatably mounted to the shaft and includes a first engaging portion. The blade carrier is movably received between the first housing and the second housing, and is operable to move. The locking mechanism is disposed through the second housing and non-rotatable relative to the shaft. The locking mechanism is axially slidable between a locking position and a releasing position along the shaft and rotatable about the axis. When the locking mechanism is in the locking position, the second housing is non-rotatable relative to the first housing; when the locking mechanism is in the releasing position, the second housing is rotatable about the locking mechanism and rotatable relative to the first housing.

10 Claims, 11 Drawing Sheets

(56) References Cited

U.S. PATENT DOCUMENTS

| | | | | |
|---|---|---|---|---|
| 7,316,070 | B2 * | 1/2008 | Green | B26B 5/001 30/162 |
| 8,539,677 | B2 * | 9/2013 | Strauss | B26B 5/001 30/162 |
| 8,539,680 | B2 * | 9/2013 | Strauss | B26B 5/00 30/329 |
| 10,252,428 | B2 * | 4/2019 | Ranieri | B26B 5/001 |
| 2004/0045172 | A1 * | 3/2004 | Rowlay | B26B 5/001 30/162 |
| 2004/0158992 | A1 * | 8/2004 | Huang | B26B 5/001 30/162 |
| 2021/0039270 | A1 * | 2/2021 | Chen | B26B 5/003 |

* cited by examiner

UTILITY KNIFE

BACKGROUND OF THE INVENTION

Field of the Invention

The present invention relates to a utility knife.

Description of the Prior Art

Generally, a utility knife includes a housing, a blade carrier slidably disposed within the housing and a blade assembled to the blade carrier. The blade of the utility knife is trapezoid and has two cutting edges disposed at two opposite sides. When one of the two cutting edges is blunted or damaged, the blade is flipped to use the other of the two cutting edges or replaced by another blade.

However, the utility knife disclosed in TWI309197, for example, the blade carrier and the blade of a conventional utility knife are disposed between two housing members which are screwed to each other. Therefore, the two housing members have to be separated from each other to flip or replace the blade, which is inconvenient to assemble, disassemble and replace.

The present invention is, therefore, arisen to obviate or at least mitigate the above-mentioned disadvantages.

SUMMARY OF THE INVENTION

The main object of the present invention is to provide a utility knife with its blade quickly and safely replaceable.

To achieve the above and other objects, the present invention provides a utility knife, including: a first housing, a second housing, a blade carrier and a locking mechanism. The first housing includes a shaft disposed thereon and having an axis. The second housing is rotatably mounted to the shaft and includes a first engaging portion. The blade carrier is movably received between the first housing and the second housing, and is operable, from an outside of the first housing and the second housing, to move. The locking mechanism is disposed through the second housing and is non-rotatable relative to the shaft. The locking mechanism is axially slidable between a locking position and a releasing position along the shaft and rotatable about the axis. The locking mechanism includes a pressing end which is operable, from the outside of the first housing and the second housing, to move axially and an engaging end which is comovable with the pressing end. The engaging end includes a second engaging portion. One of the first engaging portion and the second engaging portion includes at least one engaging concave, and the other of the first engaging portion and the second engaging portion includes at least one projection which is releasably engageable with the at least one engaging concave. One of the at least one engaging concave and the at least one projection includes a first inclined surface which is tilted relative to the axis, and the other of the at least one engaging concave and the at least one projection includes an abutting portion which is abuttable against the first inclined surface. When the locking mechanism is in the locking position and the at least one projection is engaged within the at least one engaging concave, the second housing is non-rotatable relative to the first housing; when the locking mechanism is in the releasing position, the at least one projection is disengaged from the at least one engaging concave and the second housing is rotatable about the locking mechanism and rotatable relative to the first housing.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
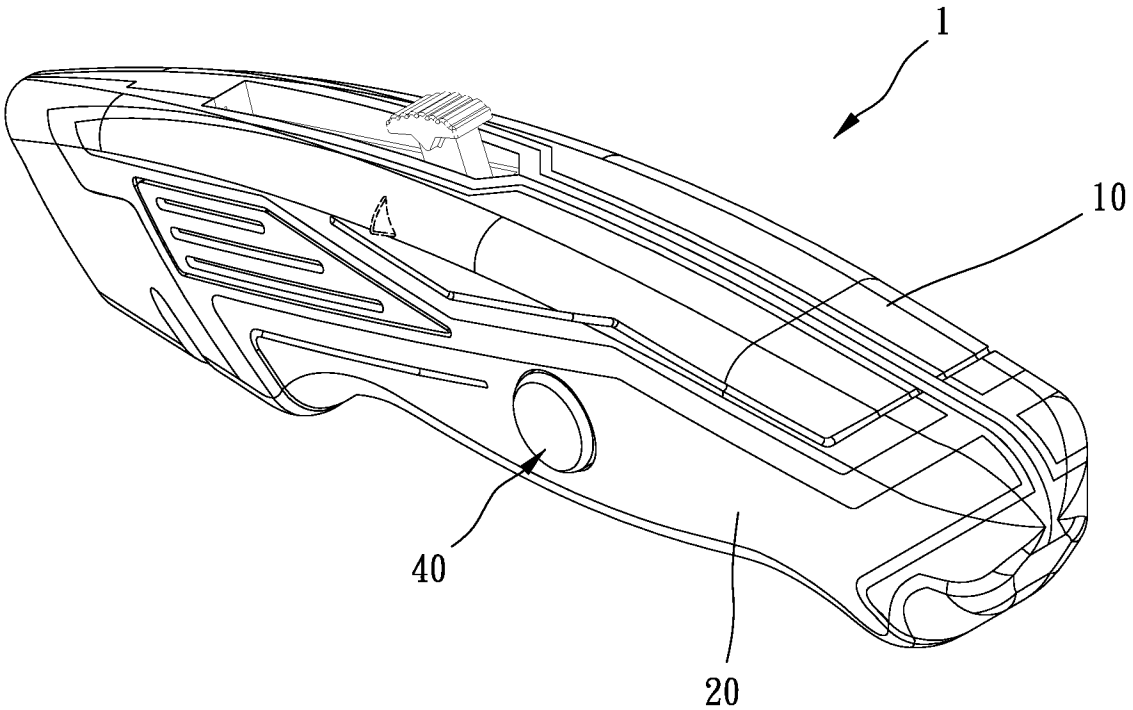
FIG. 1 is a stereogram of a preferable embodiment of the present invention.

Please refer to FIGS. 1 to 14 for a preferable embodiment of the present invention. A utility knife 1 of the present invention includes a first housing 10, a second housing 20, a blade carrier 30 and a locking mechanism 40.

Figure 5:
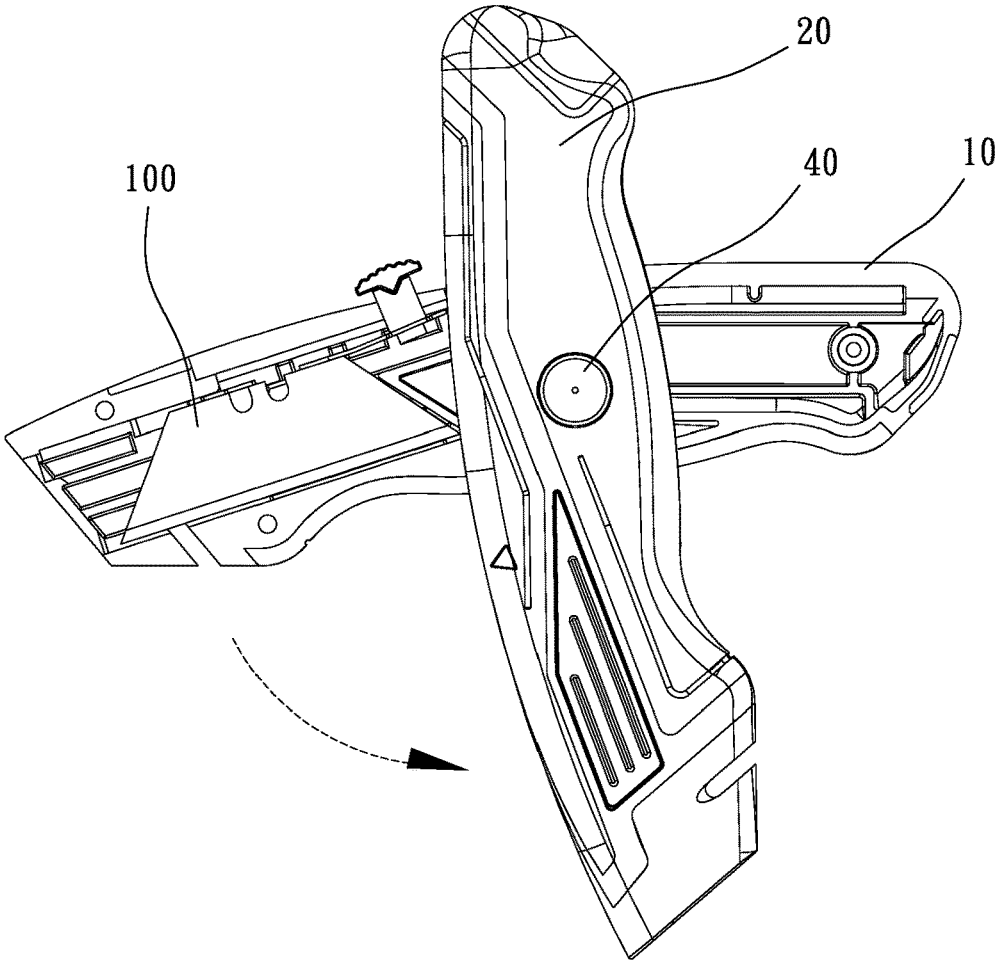
FIG. 5 is a schematic diagram of a preferable embodiment of the present invention in operation.
Figure 7:
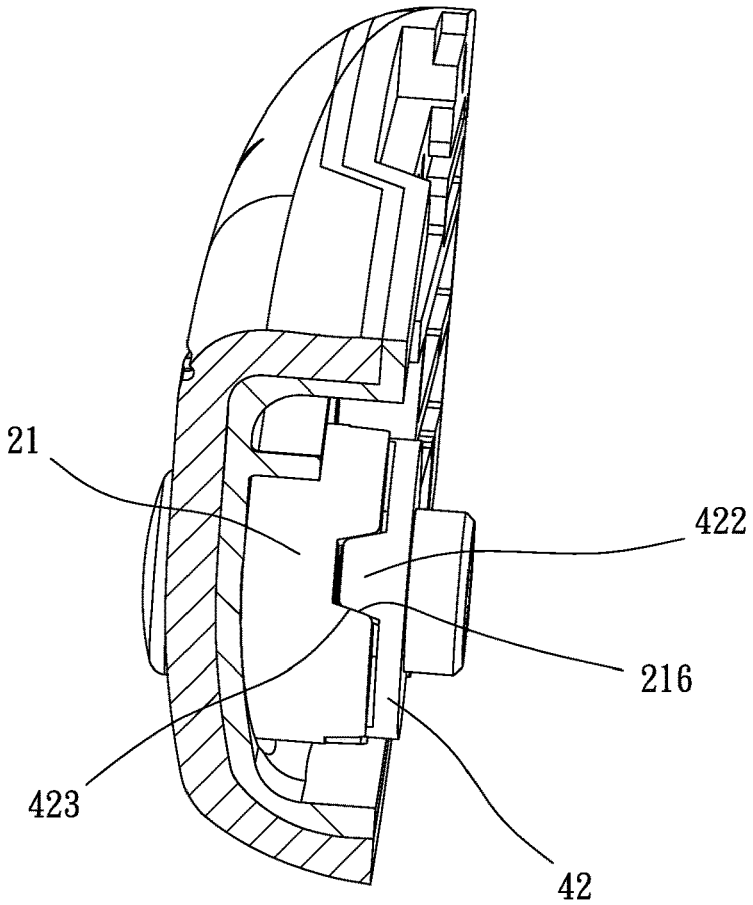
FIG. 7 is a partial cross-sectional view of a preferable embodiment of the present invention.
Figure 13:
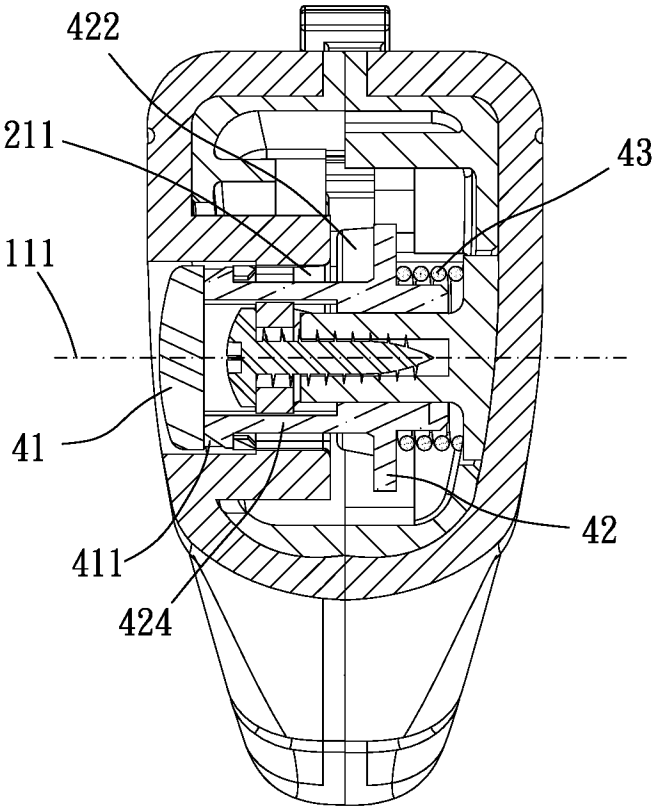
FIGS. 12 to 13 are cross-sectional views taken along line A-A of FIG. 4.
Figure 12:
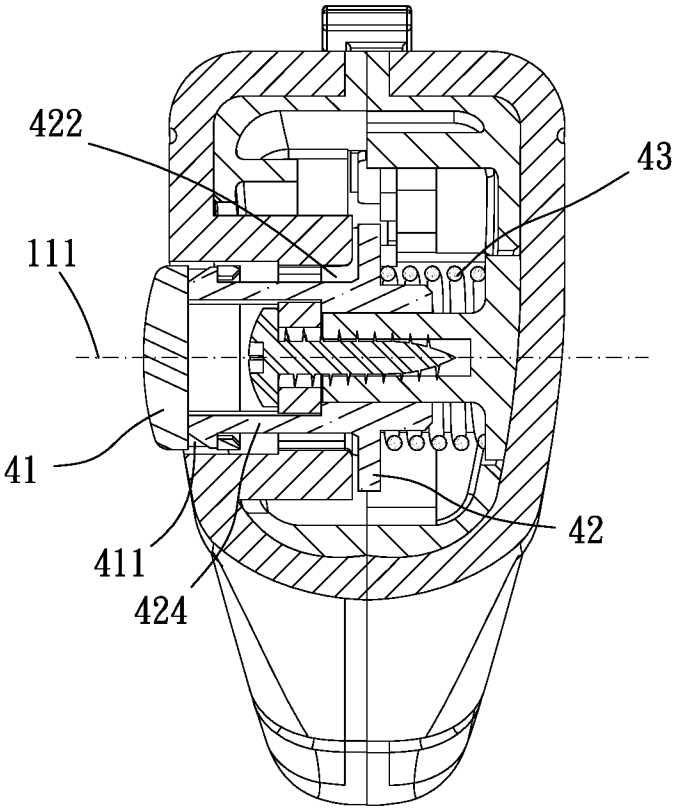

The first housing 10 includes a shaft 11 disposed thereon and having an axis 111. The second housing 20 is rotatably mounted to the shaft 11 and includes a first engaging portion 21. The blade carrier 30 is movably received between the first housing 10 and the second housing 20, and the blade carrier 30 is operable, from an outside of the first housing 10 and the second housing 20, to move. The locking mechanism 40 is disposed through the second housing 20 and is non-rotatable relative to the shaft 11. The locking mechanism 40 is preferably coaxial with the shaft 11, and the locking mechanism 40 is axially slidable between a locking position (as shown in FIGS. 7 and 12) and a releasing position (as shown in FIG. 13) along the shaft 11. The locking mechanism 40 includes a pressing end 41 which is operable, from outside of the second housing 20, to move axially and an engaging end 42 which is comovable with the pressing end 41. The engaging end 42 includes a second engaging portion 421. One of the first engaging portion 21 and the second engaging portion 421 includes at least one engaging concave 211, and the other of the first engaging portion 21 and the second engaging portion 421 includes at least one projection 422 which is releasably engageable with the at least one engaging concave 211. One of the at least one engaging concave 211 and the at least one projection 422 includes a first inclined surface 423 which is tilted relative to the axis 111, and the other of the at least one engaging concave 211 and the at least one projection 422 includes an abutting portion 212 which is abuttable against the first inclined surface 423 for stable engagement. However, the engaging concave and the projection may be configured to have no inclined surface. When the locking mechanism 40 is in the locking position and the at least one projection 422 is engaged within the at least one engaging concave 211, the second housing 20 is non-rotatable relative to the first housing 10; when the locking mechanism 40 is in the releasing position, the at least one projection 422 is disengaged from the at least one engaging concave 211 and the second housing 20 is rotatable about the locking mechanism 40 and rotatable relative to the first housing 10 (as shown in FIGS. 5 and 13). Therefore, a blade 100 of the utility knife 1 can be quickly and safely replaced.

Figure 6:
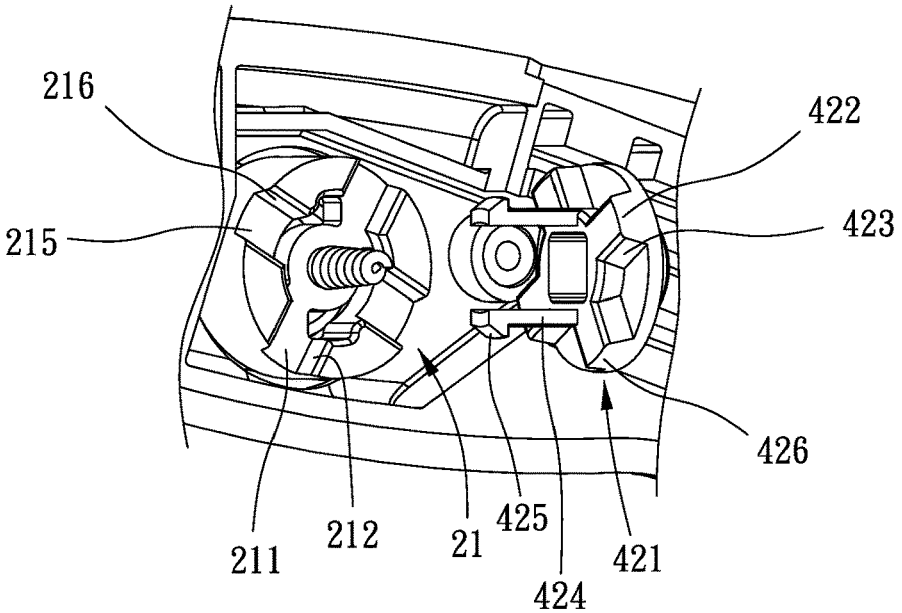
FIG. 6 is a partial schematic diagram of a preferable embodiment of the present invention.
Figure 8:
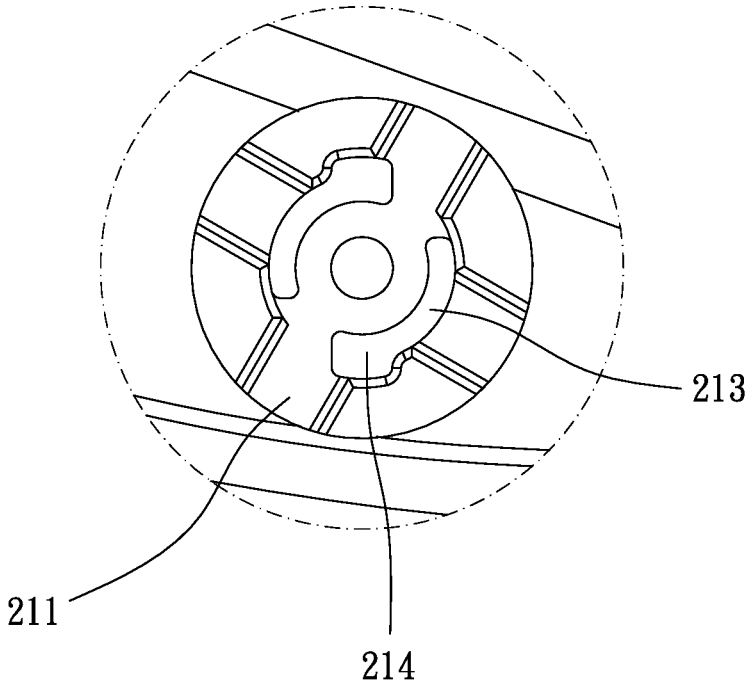
FIG. 8 is another partial schematic diagram of a preferable embodiment of the present invention.
Figure 9:
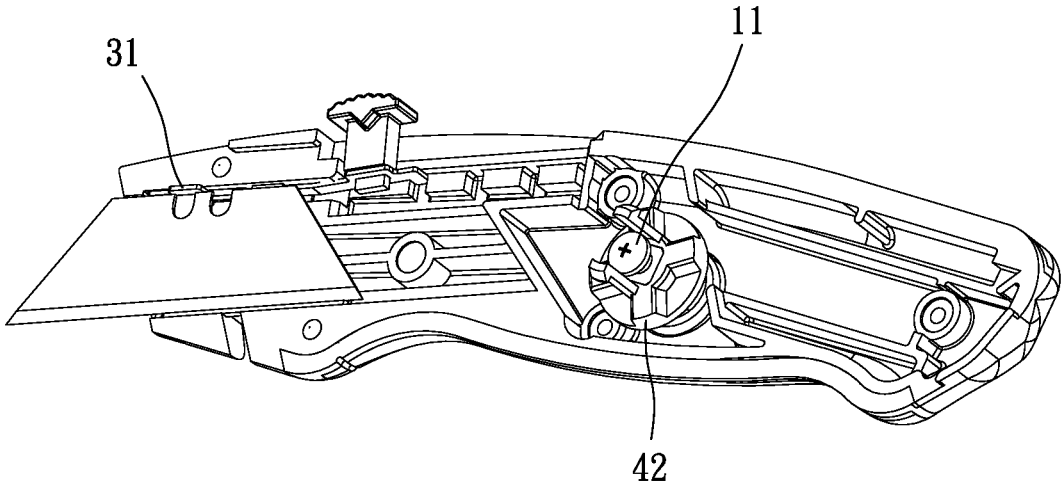
FIGS. 9 to 11 are schematic diagrams of configurations of a blade carrier and housings of a preferable embodiment of the present invention.

One of the pressing end 41 and the engaging end 42 includes at least one engaging hole 411, and the other of the pressing end 41 and the engaging end 42 includes at least one engaging arm 424 engaged with the at least one engaging hole 411. Preferably, the second housing 20 further includes at least one guiding slot 213 extending about the axis 111, and the at least one engaging arm 424 is rotatable about the axis 111 and disposed through the at least one guiding slot 213. Each of the at least one guiding slot 213 includes a broadened segment 214 which is broaden radially and outwardly so as to be convenient for the engaging arm 424 to dispose therethrough. In this embodiment, a circumferential wall of the pressing end 41 includes two of said engaging holes 411, the engaging end 42 includes two of said the engaging arms 424, a distal end of each of the two of said engaging arms 424 includes a hooked portion 425, and the second housing 20 includes two of said guiding slots 213. Each of the two of said engaging arms 424 penetrates through one of the two of said guiding slots 213 and is connected with one of the two of said engaging holes 411 by the hooked portion 425 (as shown in FIGS. 6 and 8). The second housing 20 is stably rotatable about the two of said engaging arms 424 by the two of said guiding slots 213.

In this embodiment, the second housing 20 has the at least one projection 422, and the engaging end 42 has the at least one engaging concave 211. The at least one projection 422 includes a plurality of ribs 426 extending radially, and the at least one engaging concave 211 includes a plurality of grooves 215 which extend radially and are releasably engageable with the plurality of ribs 426 so as to achieve stable engagement and multi-step positioning. In other embodiments, the at least one projection may have only one of said rib and the at least one engaging concave may include a plurality of grooves. The abutting portion 212 includes a second inclined surface 216 which is abuttable against the first inclined surface 423. Gradients of the first inclined surface 423 and the second inclined surface 216 relative to the axis 111 are substantially the same, and a depth of the engaging concave 211 is larger than a height of the projection 422 (as shown in FIG. 7); however, the gradients of the first inclined surface and the second inclined surface relative to the axis may be different from each other. Therefore, the first inclined surface 423 and the second inclined surface 216 are stably abutted against each other. The locking mechanism 40 further includes an elastic member 43 which is sleeved to the shaft 11 and elastically abutted against and between the first housing 10 and the engaging end 42 so that the abutting portion 212 is stably abutted against the first inclined surface 423.

Figure 10:
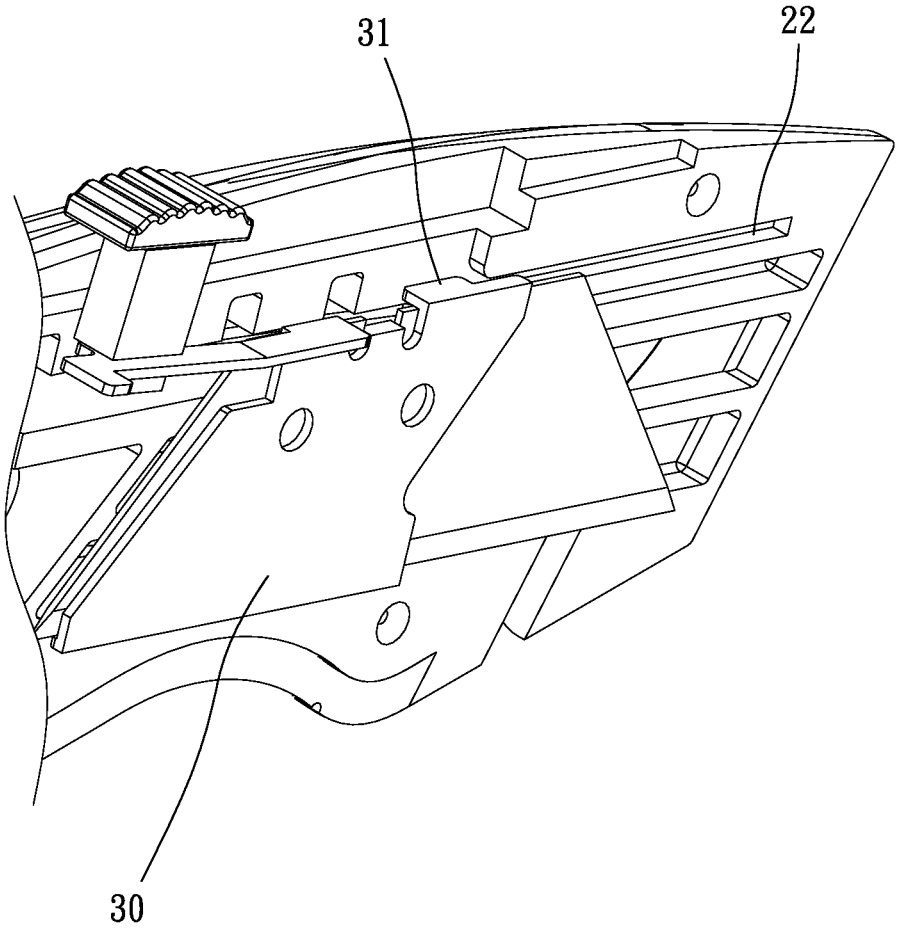
Figure 11:
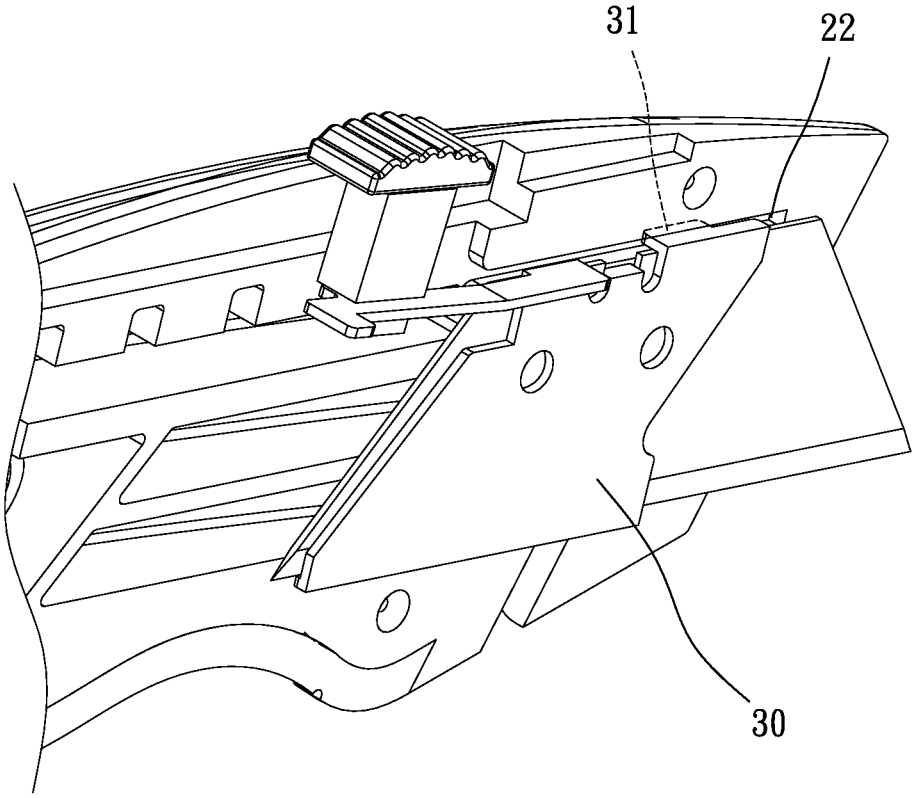
Figure 14:
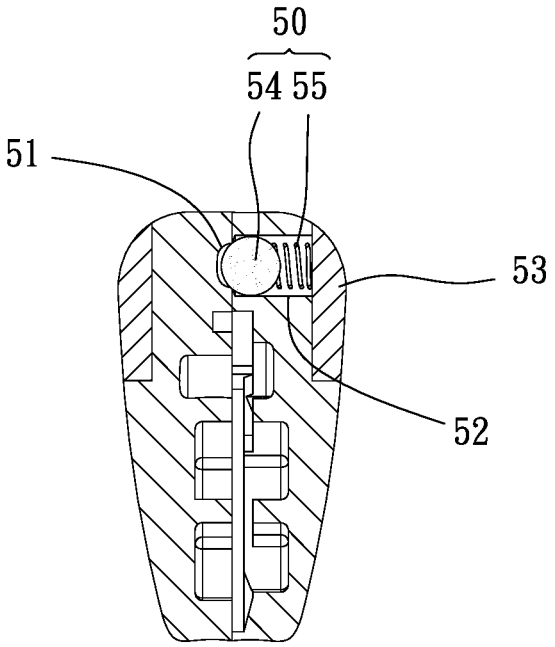
FIG. 14 is a cross-sectional view taken along line B-B of FIG. 4.

One of the first housing 10 and the second housing 20 includes at least one elastic engaging member 50, and the other of the first housing 10 and the second housing 20 includes at least one recession 51 within which is releasably engageable with the at least one elastic engaging member 50. One of the first housing 10 and the second housing 20 further includes at least one through hole 52 in which the at least one elastic engaging member 50 is received and a lid member 53 which covers the at least one through hole 52. In this embodiment, the first housing 10 has the through hole 52, and an engaging member 54 and a resilient member 55 of the at least one elastic engaging member 50 are easy to be installed into the through hole and covered by the lid member 53 (as shown in FIG. 14), without additional process of narrowing the opening of the through hole. The second housing 20 further includes a channel 22, and the blade carrier 30 includes a restricting member 31 extending in a direction toward the second housing 20 and movable into or out of the channel 22 (as shown in FIGS. 10 and 11). The blade carrier 30 is movable between a protruding position and a retracting position relative to the first housing 10. When the blade carrier 30 is in the retracting position (as shown in FIG. 10), the restricting member 31 is located out of the channel 22 and free of interference with the second housing 20 in a rotational direction of the second housing 20, and the second housing 20 is rotatable about the locking mechanism 40 and rotatable relative to the first housing 10 when the locking mechanism 40 is in the releasing position; when the blade carrier 30 is moved toward the protruding position (as shown in FIG. 11), the restricting member 31 is moved into the channel 22 and the second housing 20 is non-rotatable relative to the first housing 10. For safety, the second housing 20 is rotatable only when the blade 100 is entirely retracted.

Figure 2:
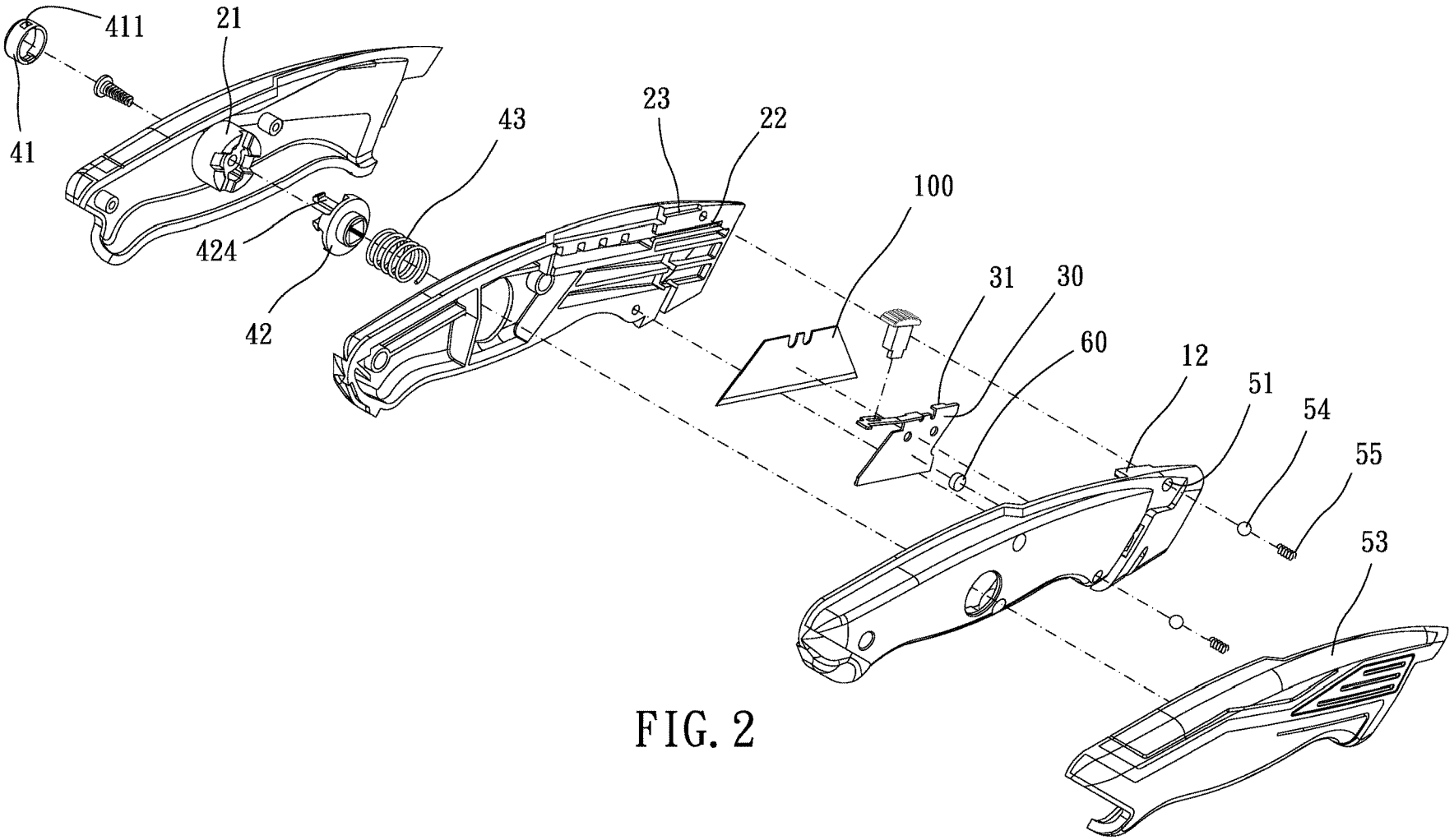
FIG. 2 is a breakdown drawing of a preferable embodiment of the present invention.
Figure 3:
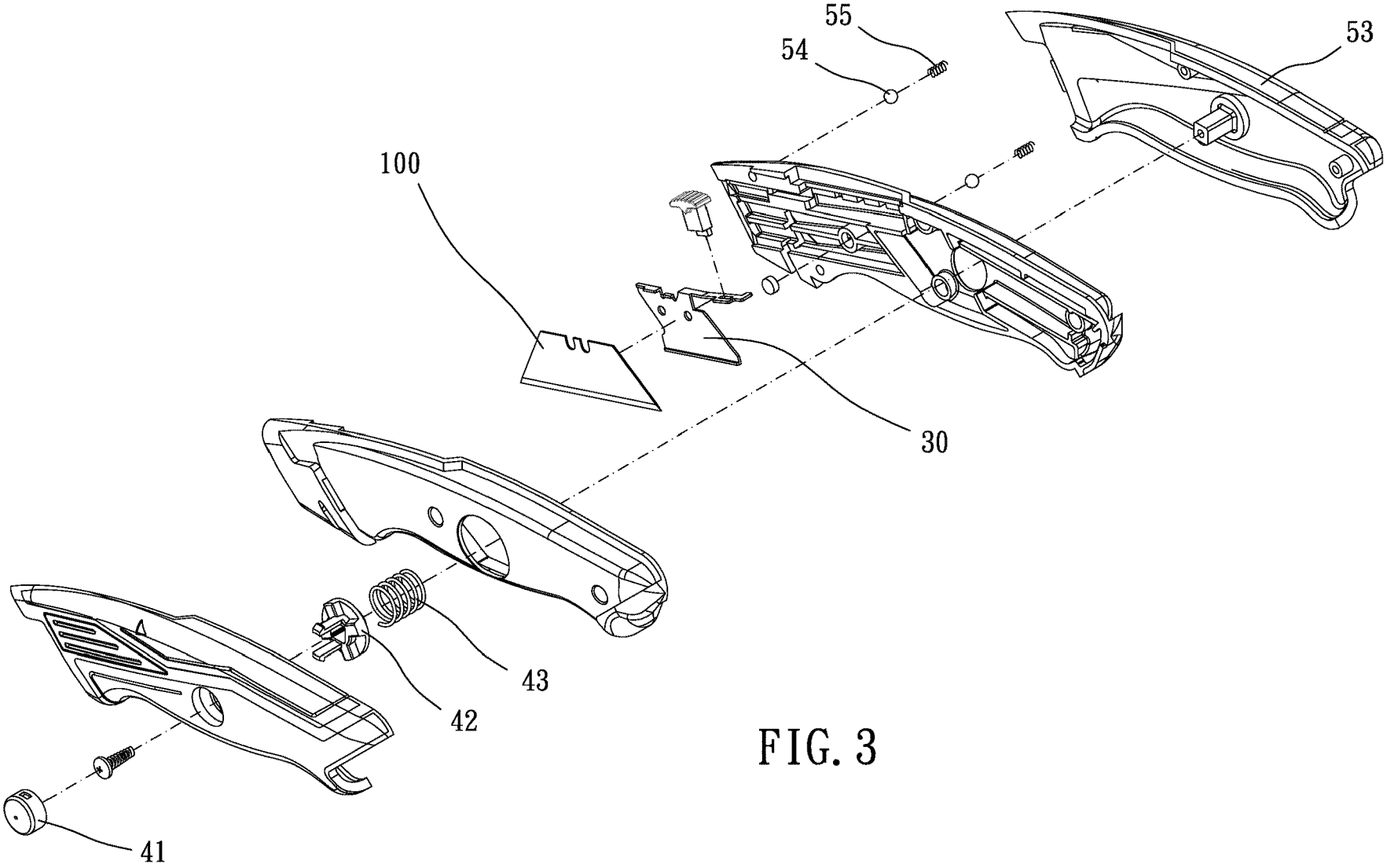
FIG. 3 is another breakdown drawing of a preferable embodiment of the present invention.
Figure 4:
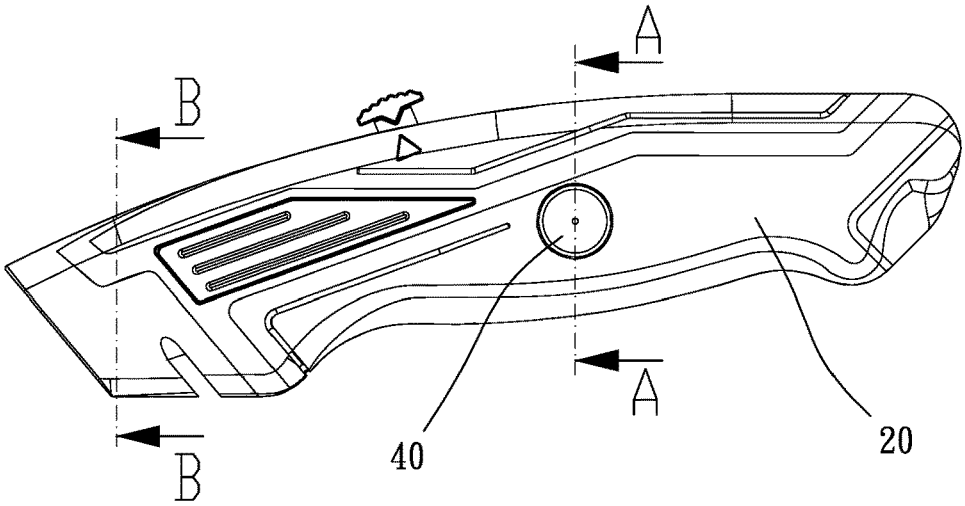
FIG. 4 is a side view of a preferable embodiment of the present invention.

Preferably, the first housing 10 further includes a magnetically attractable member 60 (as shown in FIGS. 2 and 3), and the magnetically attractable member 60 and the blade carrier 30 are magnetically attractable to each other. At least one of the magnetically attractable member 60 and the blade carrier 30 has magnetism. For example, the magnetically attractable member 60 is a magnet, and the blade carrier 30 includes magnetically attractable metal material. Therefore, the blade carrier 30 is magnetically attractable by the magnetically attractable member 60 and the blade carrier 30 can be held on the first housing 10 during removement of the blade 100 from the blade carrier 30. One of the first housing 10 and the second housing 20 preferably include a blocking edge 12 which is blockable with the other of the first housing 10 and the second housing 20 so as to ensure closed positions of the first housing 10 and the second housing 20. Preferably, the other of the first housing 10 and the second housing 20 includes a notch 23 or inner blocking shoulder for stopping the blocking edge 12 (as shown in FIG. 2) so as to have a smooth appearance.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A utility knife, including:

a first housing, including a shaft disposed thereon and having an axis;

a second housing, rotatably mounted to the shaft and including a first engaging portion;

a blade carrier, movably received between the first housing and the second housing, and being operable, from an outside of the first housing and the second housing, to move;

a locking mechanism, disposed through the second housing and being non-rotatable relative to the shaft, the locking mechanism being axially slidable between a locking position and a releasing position along the shaft, the locking mechanism including a pressing end which is operable, from outside of the second housing, to move axially and an engaging end which is comovable with the pressing end, the engaging end including a second engaging portion;

wherein one of the first engaging portion and the second engaging portion includes at least one engaging concave, and the other of the first engaging portion and the second engaging portion includes at least one projection which is releasably engageable with the at least one engaging concave, one of the at least one engaging concave and the at least one projection includes a first inclined surface which is tilted relative to the axis, and the other of the at least one engaging concave and the at least one projection includes an abutting portion which is abuttable against the first inclined surface;

wherein when the locking mechanism is in the locking position and the at least one projection is engaged within the at least one engaging concave, the second housing is non-rotatable relative to the first housing; when the locking mechanism is in the releasing position, the at least one projection is disengaged from the at least one engaging concave and the second housing is rotatable about the locking mechanism and rotatable relative to the first housing.

2. The utility knife of claim 1, wherein one of the pressing end and the engaging end includes at least one engaging hole, and the other of the pressing end and the engaging end includes at least one engaging arm engaged with the at least one engaging hole.

3. The utility knife of claim 2, wherein the second housing further includes at least one guiding slot extending about the axis, and the at least one engaging arm is rotatable about the axis and disposed through the at least one guiding slot.

4. The utility knife of claim 3, wherein each of the at least one guiding slot includes a broadened segment which is broaden radially and outwardly.

5. The utility knife of claim 1, wherein one of the first housing and the second housing includes at least one elastic engaging member, and the other of the first housing and the second housing includes at least one recession within which is releasably engageable with the at least one elastic engaging member.

6. The utility knife of claim 5, wherein one of the first housing and the second housing further includes at least one through hole in which the at least one elastic engaging member is received and a lid member which covers the at least one through hole.

7. The utility knife of claim 1, wherein the at least one projection includes a plurality of ribs extending radially, and the at least one engaging concave includes a plurality of grooves which extend radially and are releasably engageable with the plurality of ribs.

8. The utility knife of claim 1, wherein the first housing further includes a magnetically attractable member, and the magnetically attractable member and the blade carrier are magnetically attractable to each other.

9. The utility knife of claim 1, wherein the abutting portion includes a second inclined surface which is abuttable against the first inclined surface.

10. The utility knife of claim 1, wherein the second housing further includes a channel, the blade carrier includes a restricting member extending toward the second housing and movable into or out of the channel, the blade carrier is movable between a protruding position and a retracting position relative to the first housing; when the blade carrier is in the retracting position, the restricting member is located out of the channel and free of interference with the second housing in a rotational direction of the second housing, and the second housing is rotatable about the locking mechanism and rotatable relative to the first housing when the locking mechanism is in the releasing position;

when the blade carrier is moved toward the protruding position, the restricting member is moved into the channel and the second housing is non-rotatable relative to the first housing.

* * * * *